US007279089B2

(12) United States Patent
Vercammen

(10) Patent No.: US 7,279,089 B2
(45) Date of Patent: Oct. 9, 2007

(54) METHOD FOR PREVENTING FOULING AND CORROSION CAUSED BY AMMONIUM CHLORIDE AND AMMONIUM SULPHATES

(75) Inventor: Fernand Vercammen, Kasterlee (BE)

(73) Assignee: Kurita Europe GmbH, Viersen (DE)

( * ) Notice: Subject to any disclaimer, the term of this patent is extended or adjusted under 35 U.S.C. 154(b) by 359 days.

(21) Appl. No.: 10/489,862

(22) PCT Filed: Sep. 5, 2002

(86) PCT No.: PCT/BE02/00142

§ 371 (c)(1),
(2), (4) Date: Mar. 24, 2004

(87) PCT Pub. No.: WO03/027209

PCT Pub. Date: Apr. 3, 2003

(65) Prior Publication Data

US 2004/0238405 A1 Dec. 2, 2004

(30) Foreign Application Priority Data

Sep. 27, 2001 (EP) ..... 01203659

(51) Int. Cl.
*C10G 75/04* (2006.01)
*C10G 7/10* (2006.01)

(52) U.S. Cl. ..... 208/48 AA; 208/156; 208/47

(58) Field of Classification Search ..... 208/156, 208/48 AA, 47; 585/832, 833
See application file for complete search history.

(56) References Cited

U.S. PATENT DOCUMENTS

| | | | | |
|---|---|---|---|---|
| 2,990,431 | A * | 6/1961 | Cabbage | 422/12 |
| 4,600,518 | A | 7/1986 | Ries et al. | |
| 5,256,276 | A | 10/1993 | Weaver | |
| 5,965,785 | A | 10/1999 | Murphy et al. | |
| 6,103,100 | A | 8/2000 | Hart | |

* cited by examiner

*Primary Examiner*—Glenn Caldarola
*Assistant Examiner*—John Douglas
(74) *Attorney, Agent, or Firm*—Bacon & Thomas, PLLC

(57) ABSTRACT

Method for preventing fouling and corrosion caused by ammonium chloride and ammonium sulphates, characterised in that it comprises injecting as an additive a choline or a derivative thereof.

7 Claims, 1 Drawing Sheet

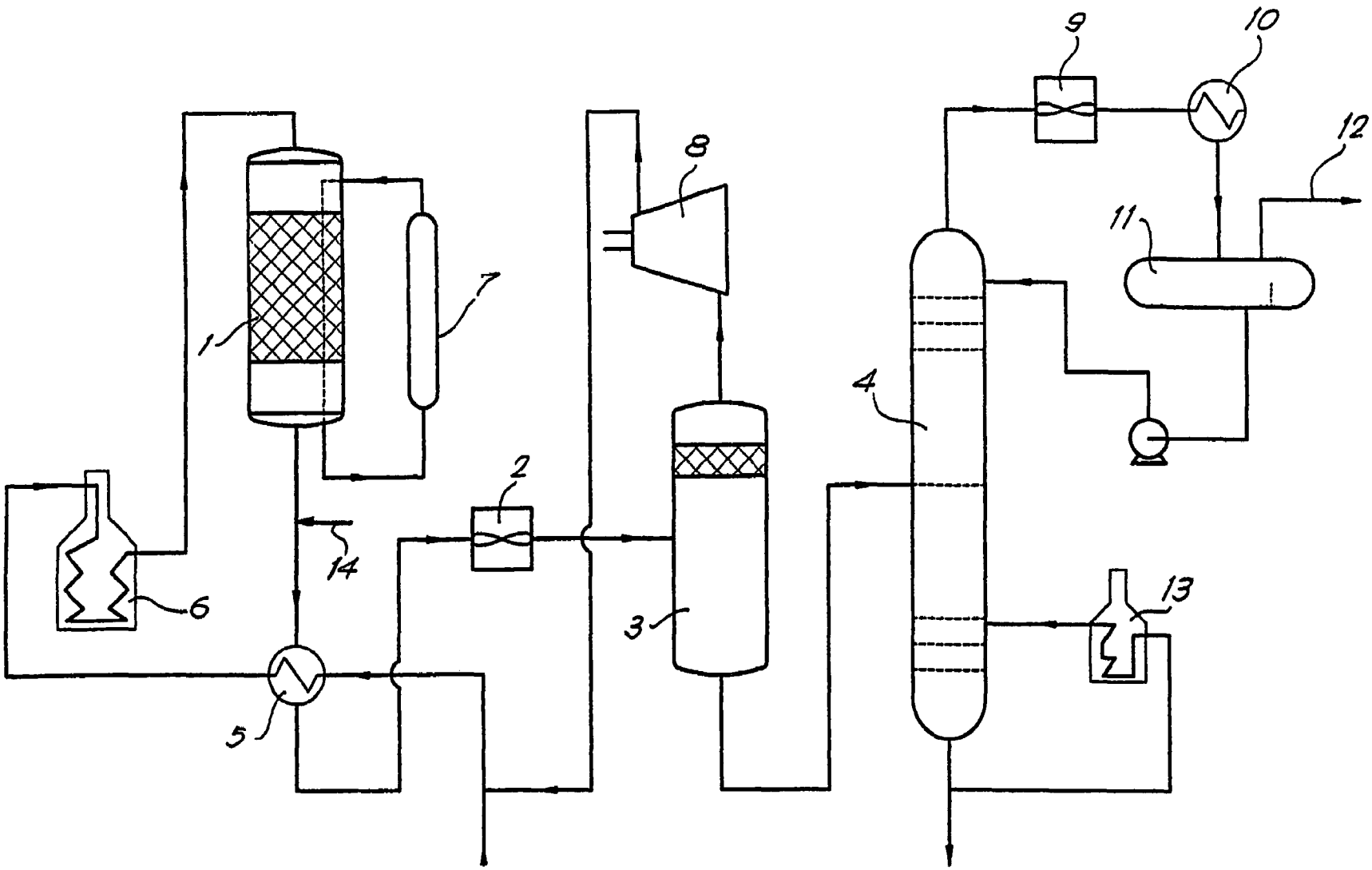
12
10
11
9
13
4
8
3
2
7
14
1
5
6

METHOD FOR PREVENTING FOULING AND CORROSION CAUSED BY AMMONIUM CHLORIDE AND AMMONIUM SULPHATES

This invention concerns a method for preventing fouling and corrosion caused by ammonium chloride and ammonium sulphates particularly formed or present in crude oil refinery processes.

From literature and field experience it is known that ammonium chloride and ammonium sulphates are corrosive, as gas, as solid, or in solution. Ammonium chloride is acidic, complexes metal ions, and contains the corrosive chloride ion. Ammonium sulphate is acidic and complexes metal ions. Therefore, corrosion protection is one of the major concerns in refinery operations where ammonium chloride and ammonium sulphates are generated through the process itself or being imported from other units with the feedstock. Several forms of corrosion are observed.

The extent of corrosion largely depends on, for example the $NH_4Cl$ concentration, the pH, and the temperature. Equipment made from iron, aluminium, lead, stainless steels, or non ferrous metals is especially prone to stress corrosion cracking.

Solid ammonium chloride has a specific gravity $d_4^{20}$ of 1.530. Its average specific heat $c_p^-$between 298 and 372° K is 1.63 kJ/kg.

Ammonium chloride has two modifications. The transformation between the two is reversible at 457.6° K (184.5° C.):

$\alpha$-$NH_4Cl$ (cubic, CsCl type) $\Leftrightarrow$ $\beta$-$NH_4$ Cl (cubic, NaCl type) $\Leftrightarrow$ $\Delta H$=+4.3 kJ/mole.

The $\alpha$ modification is the one stable at room temperature. $\beta$-$NH_4Cl$ melts at 793.2° K under 3.45 MPa; it sublimes at atmospheric pressure. In fact, $NH_4Cl$ is quite volatile at lower temperatures, dissociating into $NH_3$ and HCl:

| T, ° K | 523.2 | 543.2 | 563.2 | 583.2 | 603.2 | 611.2 |
|---|---|---|---|---|---|---|
| p, kPa | 6.6 | 13.0 | 24.7 | 45.5 | 81.4 | 101.3 |

The solubility of $NH_4Cl$ in water increases with temperature:

| T, ° K | 273.2 | 293.2 | 313.2 | 333.2 | 353.2 | 373.2 | 389.2 |
|---|---|---|---|---|---|---|---|
| c, wt % | 22.9 | 27.2 | 31.5 | 35.6 | 39.7 | 43.6 | 46.6 |

The partial pressures of saturated $NH_4Cl$ solutions show that $NH_4Cl$ is weakly hygroscopic:

| T, ° K | 283.2 | 293.2 | 303.2 | 313.2 | 323.2 | 389.2 |
|---|---|---|---|---|---|---|
| p, kPa | 1.0 | 1.9 | 3.3 | 5.4 | 8.8 | 101.3 |

Less known is that ammonium sulphate and, in particular ammonium bisulphate, also precipitates as a foulant and corrosive agent in refinery processes as described before.

Ammonium sulphates cannot be melted at atmospheric pressure without decomposition, releasing ammonia and leaving bisulphate. However, the ammonia vapour pressure of pure, anhydrous ammonium sulphates are effectively zero up to 80° C. Above 300° C., decomposition gives $N_2$, $SO_2$, $SO_3$ and $H_2O$ in addition to ammonia.

The salts do not form hydrates. The solubility of ammonium sulphates is reduced considerably by addition of ammonia: At 10° C., from 73 g $(NH_4)_2SO_4$ in 100 g of water, nearly linearly, to 18 g salt in 100 g of 24.5% aqueous ammonia.

The fouling and corrosion phenomena in the crude oil refinery processes, such as hydro-treating, hydro-cracking, catalytic reforming, catalytic cracking, but not limiting to these processes, is a great concern of the operator. A typical conversion refinery is spending a lot of money for maintenance, renewal of equipment, while the downtime of the unit is accounting for a substantial loss in production and profits.

Equipment being exposed to ammonium chloride fouling has to be thoroughly washed with an alkaline solution, to avoid stress-corrosion cracking. Ammonium bisulphate is depositing at higher temperatures as compared to ammonium chloride, and therefore, more difficult to remove by washing with water.

Typical areas for fouling and corrosion are, for example but not limiting, feed-effluent exchangers from reactors and distillation columns, recycle gas compressors transporting hydrogen containing ammonium chloride to the reactor feedstock, stabiliser, reboiler and overhead section.

U.S. Pat. No. 5,256,276 relates to a method for inhibition and removal of formed ammonium chloride, being sublimed and creating deposits in a crude oil distillation unit, by adding a phosphatide, preferably lecithin, to it. Such phosphatide components may have adverse effects on the effectiveness of downstream hydrotreating and reforming catalysts and, due to their emulsification effect, also may have adverse effects on the naphta-water mixture separation in the knock-out drums.

U.S. Pat. No. 5,965,785 discloses a method for inhibiting fouling and corrosion, caused by ammonium chloride, by introducing a customized multi-amine blend. It is, however, well known that the reaction products of amines with HC1 and/or H2SO4 and/or ammonium chloride and/or ammonium sulfate cause secondary corrosion, due to acidity of the contained water, when a sticky deposit is formed and/or due to the dissociation of these reaction products, which are salts, when they are dissolved in the condensing water in the lower temperature area of the overhead systems.

It is also well known that amine chloride salts dissociate to amine and hydrochloric acid by thermal decomposition or evaporate (sublime) as a form of amine-HC1 salt by heating and then deposit in the overhead system at lowered temperature, causing the abovementioned corrosion problems.

In order to cover the above defects, amines, for example, need to be injected at plural points before and after overhead, which is a rather complicated treatment, differently from the present invention.

U.S. Pat. No. 4,600,518 discloses a method for neutralizing naphtenic acids contained in refinery products, like fuels and lubricating oils, by adding choline. This method makes us of the strong basicity of choline to neutralize acidic napthenic components. The reaction products of the neutralisation reaction will remain in the liquid products.

The invention aims to provide a method for preventing fouling and corrosion caused by ammonium chloride and ammonium sulphates.

According to the invention this aim is reached by injecting as an additive a choline or a derivative thereof, more specifically a derivative with one of the following general formulas:

$(CH_3)_3N^+—CH_2CH_2—O^-$, $(CH_3)_3N^+—CH_2CH_2—OH—O^-H$, and $(CH_3)_3N^+—CH_2CH_2—OH—O^-R$, wherein R=an alkyl with $C_1$-$C_{20}$.

Choline, known as choline base, is a liquid strong organic base: trimethyl(2-hydroxyethyl)ammoniumhydroxide having the general formula $[(CH_3)_3N^+—CH_2CH_2—OH]—OH^-$. It is usually not encountered as a free base, but as a salt or derivative such as choline hydroxyde, choline chloride, choline hydrogen tartrate, tricholine citrate which are commercially available and are used in medical applications and as nutrients.

By injection, the additive to the process flow, the ammonium chloride and ammonium sulphates are converted into non-corrosive and non-depositing components which are surprisingly liquid and neutral, freeing the various processes from fouling and corrosion created by ammonium chloride and ammonium sulphates.

It is known to add amines for corrosion inhibition, but these amines form a salt which remains sticky (form a paste) or solid, and when dissolved in water show an acidic pH value (<7.0).

Also surprisingly, the chloride salt formed with the additive is a volatile chloride which can be removed from the process stream by stripping or gas recycling.

The method is particularly useful in crude oil refinery processes.

In a particular unit called catalytic reformer, the volatile formed component can be recycled through the hydrogen recycle gas stream to the reactor, thereby reducing the amount of organic chloride used for activation of the reformer catalyst. Up to 40% savings in organic chloride product has been demonstrated in a pilot plant.

The quantity of additive injected, is preferably situated between 1 ppm and 5000 ppm, dosed on the amount of chlorides or sulphates present.

The additive is preferably injected as a solution containing 1% weight to 65% weight additive in a solvent, for example an alcohol, preferably an aliphatic alcohol having up to 8 C atoms, an ether, an aromatic or water. The concentration of the choline base of choline derivative in the solution may for example vary from 1% to 65% in weight. A stabiliser may be added such as for example an unsubstituted hydroxylamine salt.

The additive is usually fed upstream the formation or deposition of ammonium chloride and ammonium sulphates to prevent formation of ammonium chloride and ammonium sulphates or to convert ammonium chloride and ammonium sulphates to other components.

The additive may also be fed downstream the formation or deposition of ammonium chloride and ammonium sulphates to convert ammonium chloride and ammonium sulphates to other components, but it is not limiting its feeding point to a particular place in the process.

The following example explains the invention:

A pilot catalytic reformer with continuous regeneration catalyst, shown in the enclosed FIGURE, is used to test the performance of the additive at various levels of ammonia and chloride. As shown in the FIGURE, this reformer comprises mainly a reactor 1, an airfin cooler 2, a separator 3 and a stabiliser 4 mounted in series.

The feedstock is fed to the reactor 1 over a feed-effluent exchanger 5 and a catalytic reformer furnace 6.

The feedstock consists of a typical heavy full range naphta with varying levels of ammonia and with an end boiling point of 192° C. The hydrogen to hydrocarbon molar ratio is 4.0 operating at an outlet temperature of 510° C. and the pressure in the reactor 1 is 9.8 bar.

The catalyst used is R 22 from UOP and is continuously recycled as shown by reference numeral 7. The organic chloride catalyst activator is fed at a rate of 2 ppm. The conditions in the reactor 1 were governed to maintain a reformate RON (Research Octane Number) of 98.

The gases from the separator 3 are compressed in compressor 8; and reintroduced in the feed stock. The liquid from the separator 4 is fed to the reformate stabiliser 4. The gases are cooled in airfin cooler 9 followed by a water cooler 10 and then collected in an overhead accumulator 11. The remaining gases are evacuated via the off-gas 12, while the liquid is returned as a reflux to the upper part of the stabiliser 4. The reformate is evacuated from the bottom of the stabiliser 4 and part of it is recycled over a stabiliser reboiler furnace 13.

Blank Test:

| Product Analysis | Feedstock in ppm | Reactor Outlet Reformate ppm | Stabiliser feed Ppm | Recycle gas Ppm | Stabiliser off-gas Ppm | Stabilised reformate ppm |
|---|---|---|---|---|---|---|
| $NH_3$ | 1.5 | — | — | — | — | — |
| HCl | 0.5 | — | — | — | — | — |
| $NH_4Cl$ | — | 2.5 | 1.3 | 0.3 | <0.1 | <0.1 |
| RCl | 2* | — | — | — | — | — |

*Organic chloride fed to reactor

| Analysis/ Observation | Hydrogen recycle airfin cooler | Stabiliser overhead airfin cooler | Stabiliser overhead water cooler | Stabiliser overhead accumulator |
|---|---|---|---|---|
| Corrosion rate | 0.559 mmpy (22 mpy) | 1.143 mmpy (45 mpy) | 1.727 mmpy (68 mpy) | 0.940 mmpy (37 mpy) |
| Salt deposition | Yes | Yes | Yes | No |
| pH saturated water | 2.7 | 2.3 | 1.7 | 3.5 |

Test Data:

A solution of 44 wt. % of trimethyl(2-hydroxyethyl) ammonium hydroxide or choline in methanol to which 1% hydroxylamine acetate was added as stabiliser, was fed to the reformate leaving the reactor 1 prior to the feed-effluent exchanger 5 at a dosage rate of 4.5 ppm per ppm chloride based on mass flow-rate, as indicated by the arrow 14 in the FIGURE.

Pilot data have shown that the corrosion due to ammonium chloride can be reduced to levels below 0.270 mpy (millimeter per year), which is the same as 5 mpy (mills per year) and fouling created by ammonium chloride can be eliminated completely.

Also the amount of RCl (organic chloride) fed to the reactor could be reduced by 40% as demonstrated through the analyses of $CH_3Cl$ in the recycle gas stream.

| Product Analysis | Feedstock in ppm | Reactor Outlet Reformate ppm | Stabi-liser feed Ppm | Recycle gas Ppm | Stabi-liser off-gas Ppm | Stabilised reformate Ppm |
|---|---|---|---|---|---|---|
| $NH_3$ | 1.5 | — | — | — | — | — |
| HCl | 0.5 | — | — | — | — | — |
| $NH_4Cl$ | — | 2.5 | <0.1 | <0.1 | <0.1 | <0.1 |
| $CH_3Cl$ | — | — | <0.1 | 1.1 | <0.1 | <0.1 |
| RCl | 2* | — | — | — | — | — |

*Organic chloride fed to reactor

| Analysis/ Observation | Hydrogen recycle airfin cooler | Stabiliser overhead airfin Cooler | Stabiliser overhead water cooler | Stabiliser overhead accumulator |
|---|---|---|---|---|
| Corrosion rate | 0.076 mmpy (3 mpy) | 0.051 mmpy (2 mpy) | 0.102 mmpy (4 mpy) | 0.038 mmpy (1.5 mpy) |
| Salt deposition | No | No | No | No |
| pH saturated water | 6.3 | 7.6 | 7.0 | 7.1 |

The additive can be applied under a wide range of temperatures and pressures, usually between 2 kPa (0.02 $bar_a$) and 20 MPa (200 $bar_a$) and −10° C. and +250° C.

In other embodiments, the additive was a derivative of choline with the general formula $(CH_3)_3\,N^+—CH_2CH_2—O^-$, $(CH_3)_3\,N^+—CH_2CH_2—OH—O^-H$, or $(CH_3)_3\,N^+—CH_2CH_2—OH—O^-R$, wherein R=an alkyl with $C_1$-$C_{20}$.

such as a choline hydrogen tartrate, choline dihydrogen citrate, tricholine citrate or choline gluconate.

Dosages are usually determined through the analysed or calculated concentration of ammonia and hydrochloric acid, or by dew point calculations of the sublimation of ammonium chloride or ammonium sulphates. The dosage could be as low as 1 mg/l up to 5000 mg/l.

The invention claimed is:

1. Method for preventing fouling and corrosion caused by ammonium chloride and ammonium sulphates, wherein this method comprises injecting as an additive into a crude oil refinery process a choline or a derivative thereof to prevent fouling and corrosion caused by ammonium chloride and ammonium sulphates, characterised in that a choline derivative is added with one of the following general formulas:

$(CH_3)_3N^+—CH_2CH_2—O^-$, $(CH_3)_3N^+—CH_2CH_2—OH\ —O^-H$, and $(CH_3)_3N^+—CH_2CH_2—OH—O^-R$, wherein R=an alkyl with $C_1$-$C_{20}$.

2. Method according to claim 1, characterised in that the volatile component formed by the additive is removed by stripping or gas recycling.

3. Method according to claim 2, characterised in that the volatile component formed by the additive is recycled through the hydrogen recycle gas stream.

4. Method according to claim 3, characterised in that the additive is injected at a process pressure between 2 kPa (0.02 $bar_a$) and 20 MPa (200 $bar_a$) and a temperature between −10° C. and +250° C.

5. Method according to claim 1, characterised in that the quantity of additive injected is situated between 1 ppm and 5000 ppm, dosed on the amount of chlorides or sulphates present.

6. Method according to claim 1, characterised in that the additive is injected as a solution containing 1% weight to 65% weight additive in a solvent.

7. Method according to claim 6, characterised in that a solution of choline or a choline derivative in an alcohol, an ether, an aromatic or water.

* * * * *